United States Patent [19]

Deal

[11] 4,428,742

[45] Jan. 31, 1984

[54] FOLDING MECHANISM FOR USE ON A CARTONING MACHINE

[75] Inventor: Philip A. Deal, Winston-Salem, N.C.

[73] Assignee: R. J. Reynolds Tobacco Company, Winston-Salem, N.C.

[21] Appl. No.: 63,620

[22] Filed: Aug. 3, 1979

[51] Int. Cl.[3] ..... B31B 1/52; B31B 1/64

[52] U.S. Cl. ..... 493/142; 53/374; 53/387; 493/179; 493/183

[58] Field of Search ..... 93/36.3, 49 R, 49 M, 93/12 C, 12 R; 53/374, 387

[56] References Cited

U.S. PATENT DOCUMENTS

| | | | |
|---|---|---|---|
| 1,025,882 | 5/1912 | Rose | 53/387 X |
| 2,313,643 | 3/1943 | Howard | 53/374 X |
| 3,350,841 | 11/1967 | McDonald | 53/374 X |
| 3,397,624 | 8/1968 | Currie, Jr. et al. | 93/36.3 |
| 4,102,252 | 7/1978 | Reichert | 93/36.3 |
| 4,173,921 | 11/1979 | Mack | 93/36.3 |

*Primary Examiner*—James F. Coan

*Attorney, Agent, or Firm*—Grover M. Myers

[57] ABSTRACT

A folding apparatus for use on a cartoning machine which folds and secures the end flaps of a blank to form a carton including a pivoting rocker arm positioned adjacent to the path of said carton movement and a fold blade pivotedly attached to one end of said rocker arm which engages the flap and moves it into contact with the side of the carton. A device for manipulating said rocker arm is provided so that the fold blade will engage and disengage the flap and a yieldable means associated with said fold blade to apply a selected pressure to said flap with a roller assembly for engaging the fold blade and control the pressure applied by said yieldable means.

5 Claims, 7 Drawing Figures

FOLDING MECHANISM FOR USE ON A CARTONING MACHINE

TECHNICAL FIELD

This invention relates to a folding mechanism for use on a cartoning machine and, more particularly, to an improved double pivot folding mechanism for use on a cigarette package cartoning machine.

BACKGROUND OF THE INVENTION

Presently, there are a number of carton forming devices or boxers used throughout the industry. One of the most widely used in the tobacco industry is a boxer manufactured by Molins Limited of London, England which is commonly referred to within the tobacco industry as the "Molins Boxer". Boxer or cartoning machine and like terms are used interchangeably herein and are common terms used for machines which fold blanks around articles to form boxes or cartons. Although the Molins Boxer has worked satisfactorily as long as there are no stoppages during the machine cycle, a number of problems are encountered if there is a stoppage. The major problem encountered when a stoppage occurs is that the glue dries and the flaps of the carton are not always sealed against the side of the carton before the carton passes from the folding section into the heater section for final sealing. If an incomplete seal exists, as the cartons are passed from the folding section to the heater section, the flaps will pop up and often become damaged.

Even when the glue only partially dries, the folding mechanism of the Molins Boxer may not apply sufficient pressure to insure that the carton will seal.

These stoppages or idling time produce numerous damaged or unsealed cartons. Of course, when a carton is damaged, it must be removed from the production line. Even if the unsealed carton makes it through the carton machine without being damaged, it is undesirable from a marketing standpoint to have unsealed cartons shipped for purchase by consumers. Thus, it is not only essential to remove the damaged cartons from the production line, but the unsealed cartons must be removed as well. The cigarette packages in these damaged or unsealed cartons must be removed and recycled into other cartons, thereby increasing the cost of production. Because of these difficulties, there exists a need for a folding mechanism which will fold the carton flap down as early in the cycle as possible and maintain contact with the flap until a last possible moment before the carton is removed from the folding section to the heater section.

SUMMARY OF THE INVENTION

It is, therefore, an object of this invention to provide a pivotal folding blade for a cartoning machine which will insure the flap seal to the carton.

Another object of this invention is to provide a fold blade with a wider surface to provide added pressure to the flap and the glue line as well as a better distribution of that pressure.

Another object of this invention is to provide a fold blade which will assist in the smearing of the glue between the carton and flap.

Still another object of this invention is to provide a folding mechanism which holds the carton and flap to the side of the carton until the last possible moment during movement of the carton from the folding section to the heater section.

These and other objects are accomplished by the present invention through the use of a folding apparatus for use on a cartoning machine which folds and secures the end flaps of a blank to form a carton comprising a pivoting rocker arm positioned adjacent to the path of said carton movement, a fold blade pivotedly attached to one end of said rocker arm which engages the flap and moves the flap into contact with the side of said carton, means for manipulating said rocker arm so that said fold blade engages and disengages said flap during a folding cycle, yieldable means associated with said fold blade to apply a selected pressure to said flap, and means for controlling the application of said pressure by said yieldable means.

DESCRIPTION OF A PREFERRED EMBODIMENT

Figure 1:
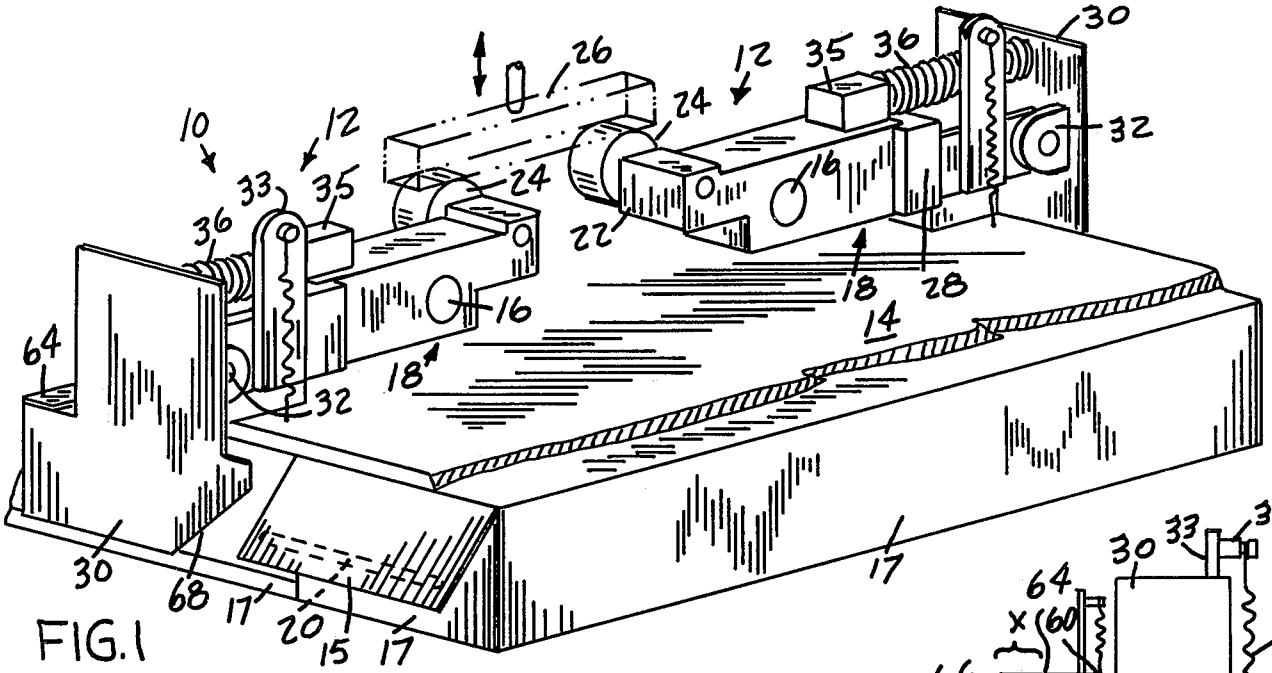
FIG. 1 is a perspective of a portion of a cartoning machine utilizing the folding mechanism according to the present invention.

In FIG. 1, the numeral 10 indicates an improved fold mechanism for a boxer or carton making machine and, in particular, for a cigarette carton making machine. The folding mechanism, which is illustrated in the down position just prior to the beginning of a machine cycle, has a double pivoting blade device 12 positioned on opposite sides of a frame or mounting plate 14. A carton 17 moves beneath the plate 14 in the direction indicated by the arrow. The pivoting blade device 12 engages the upper surface of the flap 15 of carton 17 to fold it down against the side of the carton or lower flap 19 so that an adhesive 20 which has previously been applied to the inside surface of the upper flap will secure the flap to the carton. Movement of the cartons through this portion of the boxer machine is an intermittent movement and is accomplished by the cartons contacting one another and pushing on the proceeding carton. Thus, when one carton is inserted into the boxer, another carton is forced out of the boxer. The carton passes into a folding station where the end flaps are folded down and then passes into a heater station (not shown) where a previously applied adhesive 20 is finally dried. Since the two pivoting blade devices 12 have identical elements, only one will be described.

The pivoting blade device 12 is secured to the mounting blade 14 by a pivot shaft 16. A rocker arm portion 18 of the pivoting blade device is suitably journaled to the shaft. The rocker arms 18 are generally positioned perpendicular to the direction of movement of the carton and extend in both directions from the pivot shaft 16. On the inside end 22 of the rocker arm 18 is mounted a rotating follower wheel 24 which is engaged by a flat bar 26 that reciprocates vertically, causing the opposite end of the rocker arms to pivot upwardly about shaft 16. A yoke 28 is secured on the opposite ends of the rocker arms 18 and carries a pivotal fold or tuck blade 30. The fold blade has a pair of lugs 32 secured to its rear surface which are, in turn, pivotedly secured to the parallel yoke members by pins 34 (see FIG. 2). A post or plate member 33 is secured to one side of the yoke and carries a lug 37 which has a tension spring 39 attached thereto. The other end of the spring is attached to the top of plate 14. The tension spring biases the rocker arm 18 in the down position and is overcome by the downward movement of bar 26 as it contacts followers 24. Attached to the upper surface of rocker arm 18 is a rectangular spring lug 35 which receives a compression spring 36 suitably fastened to the lug. The compression spring extends from the lug to the inside surface of the fold blade 30 and causes the fold blade to pivot about the axis of pins 34.

Figure 3:
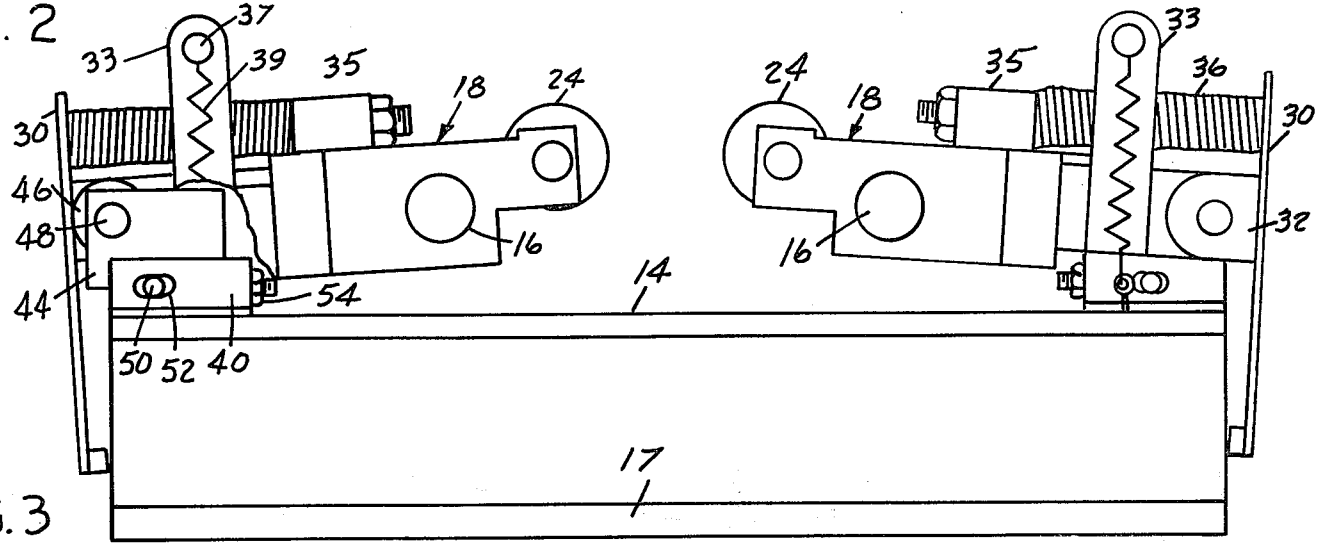
FIG. 3 is a front elevation view of the folding mechanism according to the present invention with portions of the mechanism removed to permit a clear view of the roller assembly.
Figure 4:
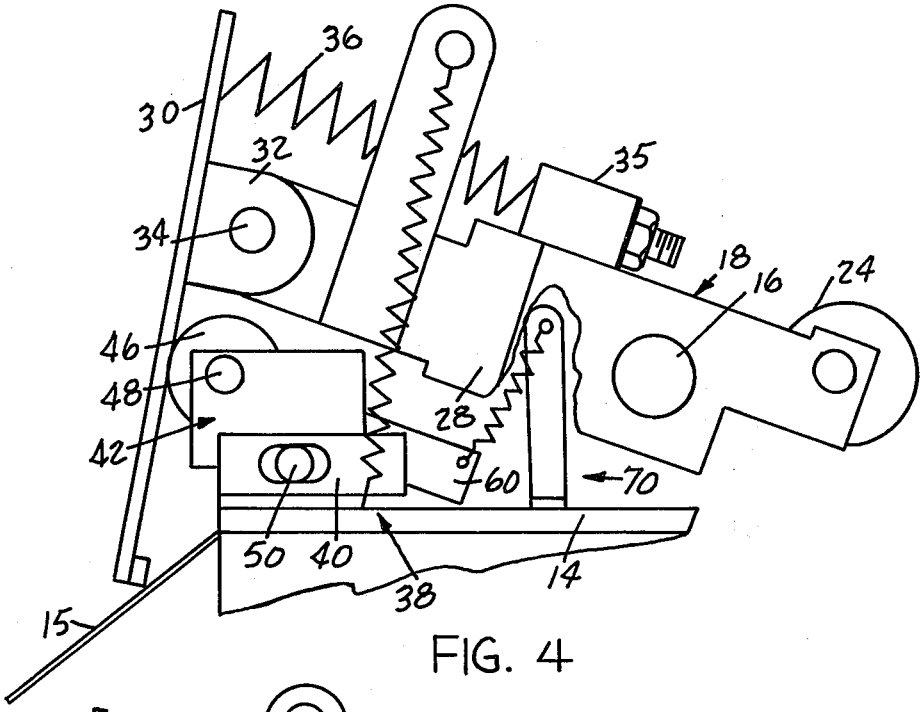
FIGS. 4, 5 and 6 are partial front elevation views illustrating a three-position sequence of the fold mechanism according to the present invention.
Figure 5:
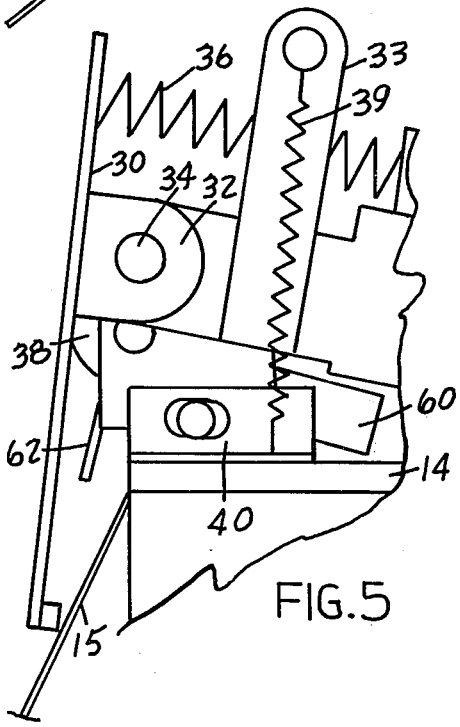
Figure 6:
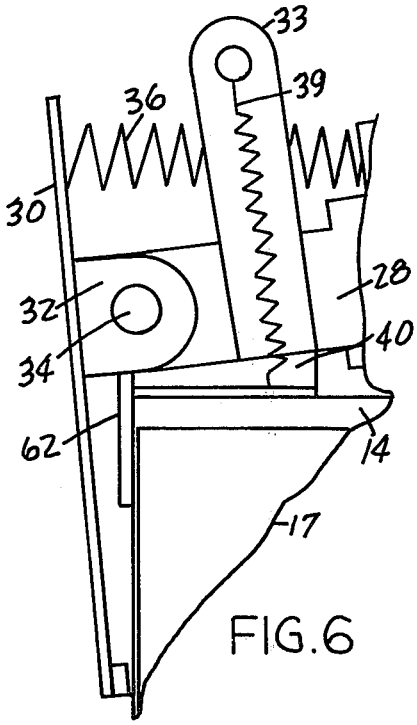

A roller assembly 38 (see FIGS. 2, 3 and 4) is secured to the upper surface of the mounting plate 14 by welding or other suitable means. A roller assembly is located within the legs of yoke 28 and includes a U-shaped base member 40 which is secured to the plate 14. Within the U-shaped member is a roller mounting block 42 that is notched at 44 to receive an idler roller or wheel 46 carried on a shaft 48. The wheel 46 contacts the inside surface of the fold blade 30 and will remain in contact with the blade as the blade pivots about the axis of shaft 34 because of the force applied by compression spring 36.

The mounting block 42 has a pin 50 on each side which extends into slots 52 in the sides of the U-shaped member 40 to permit the block to move laterally. An adjusting screw 54 is threaded into the bottom of the U-shaped member and contacts the back of the mounting block to position the mounting block laterally and prevent it from pivoting about the pins 50.

Figure 7:
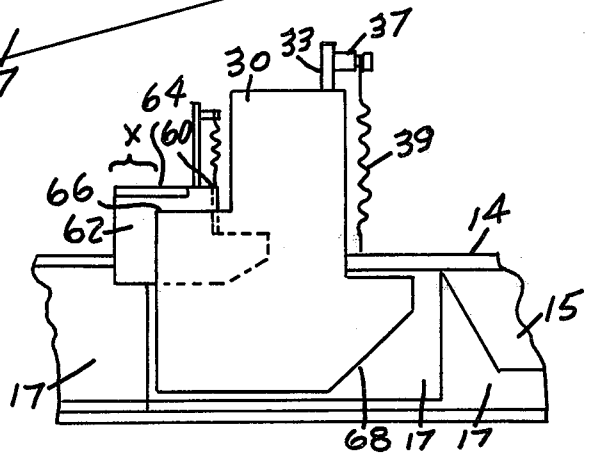
FIG. 7 is a side elevation view of the fold mechanism illustrating the fold blade and hold-down blade.
Figure 2:
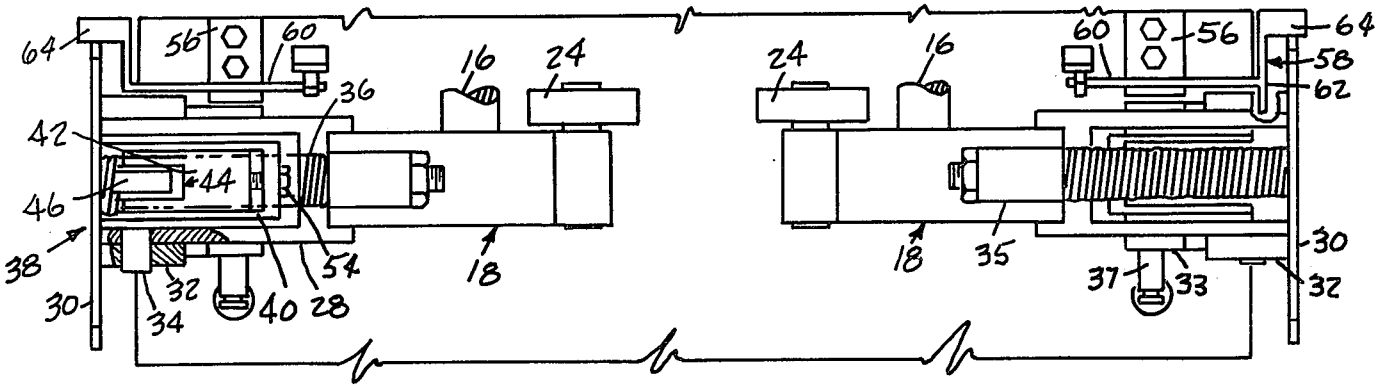
FIG. 2 is a plan view of the folding mechanism according to the present invention with a portion of one folding arm removed for clarity.

Located contiguous to the rocker arm on the downstream side of the machine is a bracket 56 which is suitably secured to the mounting block 14 and carries a secondary pivotal hold-down blade 58. As can be seen in FIG. 2, the hold-down blade 58 has a generally T-shaped configuration in the plan view. A stem 60 is pivotally attached to the bracket 56 and the cross bar 62 extending downwardly (see FIG. 7) to engage the side of the carton 17 when the fold blade 30 is in the down position. The pivot point of the stem of the hold-down blade is off-center of the stem length so that the cross bar end moves down due to a tension spring assembly 70 (see FIG. 4) to engage the side of the carton 17 when the fold blade 30 is in the down position. The hold-down blade 58 has a tab 64 which is engaged by a shoulder 66 on the downstream side of the fold blade 30 to raise the hold-down blade 58 when the fold blade 30 is raised. As can be understood by FIG. 7, there is a delay in raising the hold-down blade 58 because the shoulder 66 will not engage tab 64 until the fold blade 30 has moved upward a substantial distance. The tab 64 remains in contact with the shoulder 66 when the fold blade is in the up position, thus, preventing the hold-down blade from falling and engaging the carton. The cross bar 62 of the hold-down blade extends beyond the end of the carton 17 a slight distance X when the carton is in the folding station. On the opposite side of the blade 30 there is a diagonal cut-out 68. This diagonal cut-out permits the carton to begin moving into the folding station before the blade 30 is in its fully retracted position. The extended portion of the hold-down blade will engage the flap 15 and hold it down until the shoulder 66 lifts tab 64 as the carton slides from the folding station to the heating station. Therefore, blade 58 controls and protects the carton end flap 15 as it passes from the folding station to the heater station.

OPERATION

As the boxer or cartoning machine cycle ends, the folding mechanisms 12 are in the down position, as seen in FIG. 1. As a new cycle begins, the fold blade 30 begins to ascend to provide clearance for the coming flap 15 of the carton 17. Because of the blade movement prior to the carton movement, less clearance is required so that the diagonal cut-out on the present device is less than that required in prior devices. This permits blade 30 to be wider so that it will contact a greater area of the flap 15 and its glue line than previously contacted by the prior devices. The net result is a better distribution of pressure and coverage on the carton end flap. At approximately the midpoint of the ascent of hold-down blade 30, the cartons begin to move. The pressure against the end flap 15 is partially maintained by hold-down blade 58 to insure that the flap remains down as the carton passes into the heater section. The pressure and contact on the flap are not released until the blade 30 raises enough for shoulder 66 to engage tab 64. By this time, however, the carton end flaps are well into the heater station.

As the incoming carton 17 stops within the folding section, a glue line 20 is applied to the inside surface of the flap 15 and the fold blade 30 begins to descend. The end of the fold-down blade 30 engages the flap and moves it against the end of the carton while the hold-down blade is released to engage the flap also. The fold blade will not cause the flap to engage the carton end until the axis of pin 34 coincides with the axis of shaft 48. As the blade 30 approaches the bottom of the stroke, it pivots about pins 34 and presses against the end flap and the glue line 20. This pressure is applied while the blade is still moving downwardly.

As the blade continues to move downwardly, the contacting end of the blade assists in making a sharp fold in the carton by pulling against the flap. It also assists in smearing the glue beneath the flap. The compression spring 36 causes the blade to apply an increasing but yielding amount of pressure on the flap than would normally occur with a fixed folding blade. The blade can also maintain pressure against the flap for a longer period of time since the pressure is applied before the blade reaches its lowest position. The spring force can be adjusted to regulate the amount of pressure applied to the carton. With a fixed blade, full pressure cannot be applied until the blade is completely down.

With the increase in pressure the blade applies and the increase in time the blade is in contact with the flap, the present folding devices insure that the end flaps are sealed even when there is a slight pause at the end of the machine cycle.

It can be seen from the above description and drawings, that the above double pivoting folding device provides a wider folding blade which will put increased pressure on the flap for an increased period of time to insure that the flap is folded down and secured against the carton. It also provides a method of smearing the glue on the flap and carton and a hold-down blade which maintains the flap in a down position until the last possible moment during movement from the folding section to the heating section.

I claim:

1. An apparatus for use in a cartoning machine for folding and securing the end flaps of a blank to form a carton comprising:

(a) pivoting rocker arm positioned adjacent to the path of said carton movement;

(b) a fold blade pivotedly attached to one end of said rocker arm, said fold blade engaging and disengaging the carton flap and moving said flap against the side of the carton, said fold blade continuously describing an acute angle with the plane of said flap;

(c) means for manipulating said rocker arm so that said fold blade engages and disengages said flap during a folding cycle;

(d) yieldable means associated with said fold blade to apply a selected pressure to said flap; and (e) means for varying the pressure exerted by said fold blade against the carton flap.

2. The apparatus of claim 1, wherein said yieldable means comprises a compression spring extending between said rocker arm and said fold blade which causes said fold blade to rotate in one direction about the pivotal axis connecting said fold blade and said rocker arm.

3. The apparatus of claim 1 or 2, wherein said means for controlling the application of said pressure comprises a roller which engages said fold blade during a portion of said folding cycle and prevents the fold blade from contacting said flap.

4. The apparatus of claim 1, wherein said means for manipulating said rocker arm includes:

(a) means for biasing said rocker arm in the flap engaging position; and (b) means for overcoming said bias means during said folding cycle so that the fold blade disengages said flap.

5. The apparatus of claim 1, further including a hold-down blade means partially overlapped by by said fold blade for engaging the carton flap when the flap is in the folded position, said hold-down blade means remaining in contact with said flap after said fold blade disengages from the carton and during initial movement of said carton from the folding section.

* * * * *